United States Patent [19]

Greenleaf

[11] 4,266,357

[45] May 12, 1981

[54] MULTIPLE UNIT FLARE LAUNCHER

[75] Inventor: John M. Greenleaf, Syosset, N.Y.

[73] Assignee: Bristol Marine, Inc., Jericho, N.Y.

[21] Appl. No.: 67,964

[22] Filed: Aug. 20, 1979

Related U.S. Application Data

[63] Continuation-in-part of Ser. No. 909,223, May 24, 1978, abandoned, which is a continuation of Ser. No. 735,559, Oct. 26, 1976, abandoned.

[51] Int. Cl.[3] ..... F41C 3/02

[52] U.S. Cl. ..... 42/1 Z

[58] Field of Search ..... 42/1 Z, 1 G, 1 A, 1 R; 102/37.6, 37.7, 37.8; 116/20, 124 B, 137 R

[56] References Cited

U.S. PATENT DOCUMENTS

| | | | |
|---|---|---|---|
| 1,637,079 | 7/1927 | Karner, Jr. | 42/1 G |
| 2,113,396 | 4/1938 | Butterfield | 116/137 R |
| 2,467,165 | 4/1949 | Stimson | 116/20 |
| 2,782,748 | 2/1957 | Zegarowitz | 116/137 R |
| 3,167,050 | 1/1965 | Johnson | 116/124 B |
| 3,270,455 | 9/1966 | Smernoff et al. | 42/1 Z |
| 3,352,046 | 11/1967 | Warner et al. | 42/1 G |
| 3,385,163 | 5/1968 | Kotikov | 42/1 Z |

*Primary Examiner*—Charles T. Jordan
*Attorney, Agent, or Firm*—Nolte & Nolte

[57] ABSTRACT

A signal pack which is primarily a multiple unit flare launcher, the casing of which provides a signal mirror, and the hand grip of which provides a distress whistle. A compartment is provided in the casing for storing a distress marker dye or an orange smoke signal cannister. The flare units are disposed in verticle side by side compartments from which they are fired by a moveable bolt assembly which, in the embodiment disclosed, is rendered useless after firing the last flare unit.

12 Claims, 8 Drawing Figures

MULTIPLE UNIT FLARE LAUNCHER

This is a continuation-in-part of application Ser. No. 909,223 filed May 24, 1978, now abandoned which itself was a continuation of Ser. No. 735,559, filed Oct. 26, 1976, now abandoned.

BACKGROUND OF THE INVENTION

Distress signalling apparatus is required equipment in some marine craft and it is a primary object of the present invention to provide distress signalling apparatus for marine use; that is, providing night and day signalling means including flares, a mirror, a whistle, orange smoke or marker dye for spreading on the water surface in a distress area. Obviously, however, the signalling apparatus of the invention is useful in other than marine applications.

The invention contemplates the provision of a compact signalling unit which provides flare, mirror, dye or smoke and sound signalling which can be carried comfortably in a jacket, for instance; it is waterproof and for safety purposes, may be rendered useless after exhausting the flare supply.

THE INVENTION

The invention, therefore provides a marine signal pack which is primarily a multiple unit flare launcher, the casing of which provides a signal mirror, and the hand grip of which provides a distress whistle. A compartment is provided in the casing for storing a marker dye. Alternately, the compartment or a second compartment may store an orange smoke cannister. Self contained flare units are disposed in verticle side by side array within respective compartments, the lower ends of which communicate with a common slot within and along which a single firing pin travels within a single bolt assembly. The bolt assembly is moved from one flare unit to the next by a trigger and horizontal slide assembly while the firing pin is cocked and released at each flare unit by the cam and the release portions of horizontal tracks acting upon a firing pin cam follower.

The signal pack casing is fabricated from a sturdy plastic, such as nylon or ABS and in applications where it is intended to be disposable, the flare launcher assembly is rendered useless after firing the last flare since the firing pin remains in the firing position in the last flare unit and no means are provided for returning the firing pin and bolt assembly to an activatable position again without opening the unit.

The invention in its present physical embodiment will best be understood by reference to the drawings thereof, in which.

Figure 2:
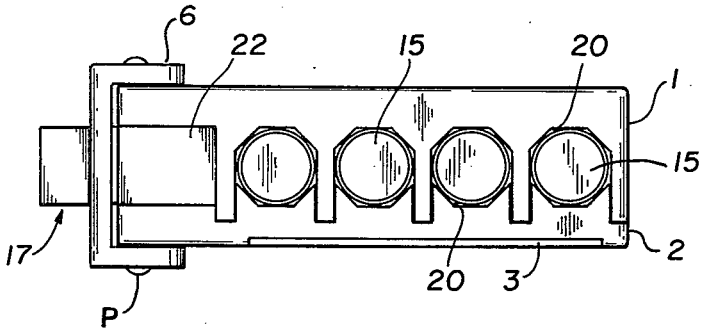
FIG. 2 is a top plan view of the pack of FIG. 1.
Figure 1:
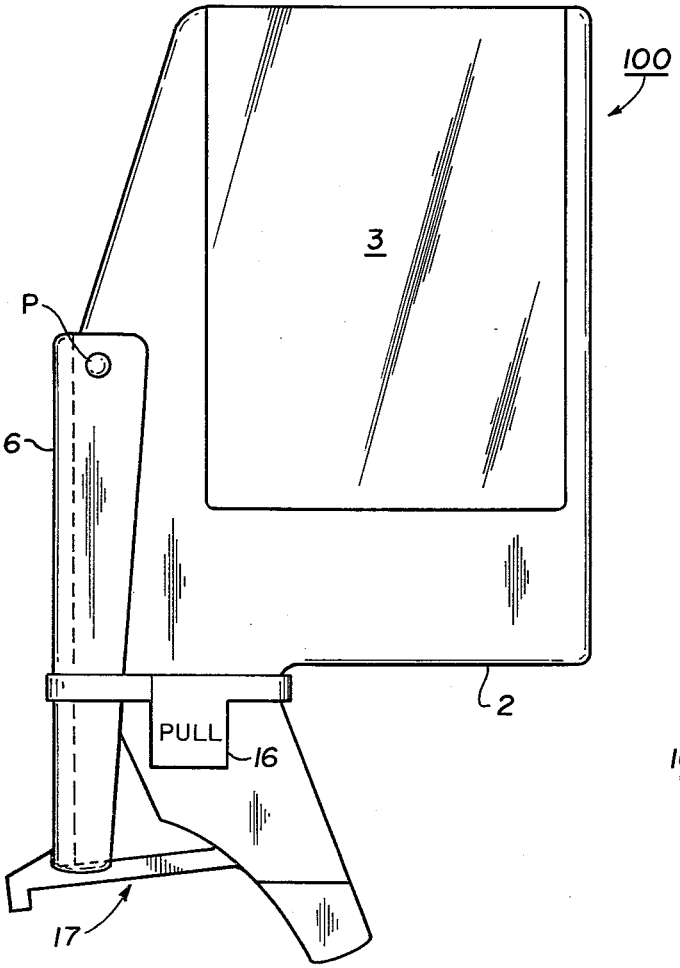
FIG. 1 is a side elevational view of the safety pack of the invention.

Referring to FIGS. 1-4, the marine signal pack 100 is comprised of an outer casing, formed by assymetric right and left hand sides 1, 2 respectively, which are fabricated from a high impact plastic.

The left hand side 2 is indented along a major portion of its face to provide an inlay area for a signal mirror 3. The right hand side is conveniently used as a flat surface to which an instruction label 4 may be applied.

As is apparent from the figures, the lower portion of the signal pack casing is shaped in the form of a hand grip for co-acting with the trigger 6 mounted via pin P to the casing.

Figure 3:
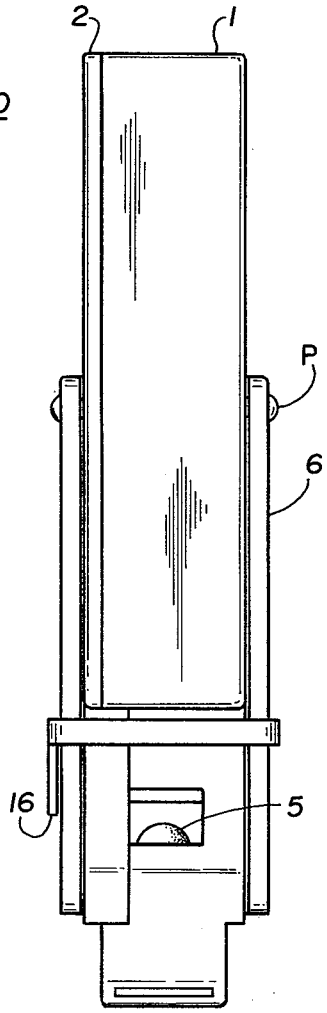
FIG. 3 is a front elevational view of the pack of FIGS. 1 and 2.
Figure 4:
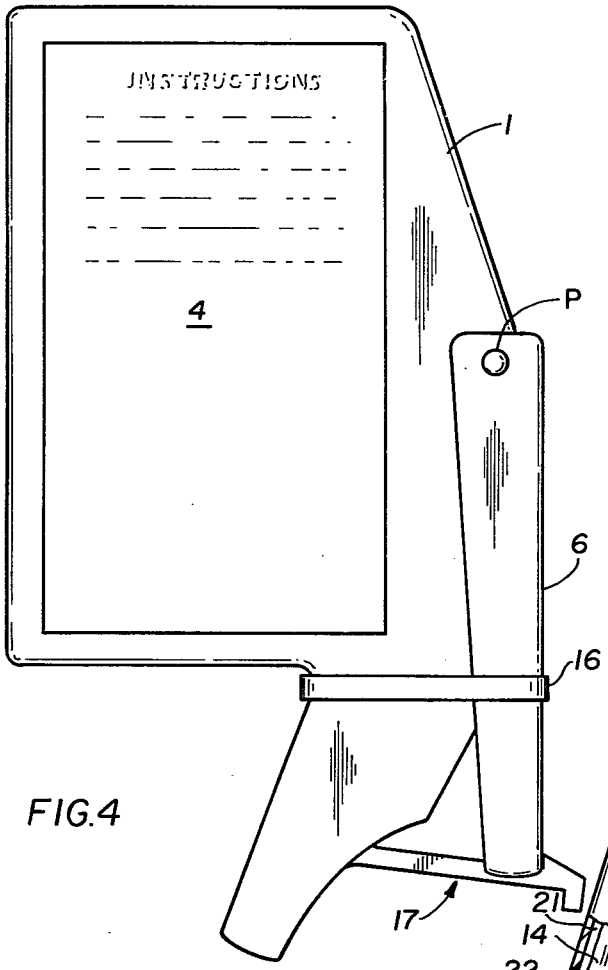
FIG. 4 is a side elevational view of the pack of FIGS. 1-3.
Figure 5:
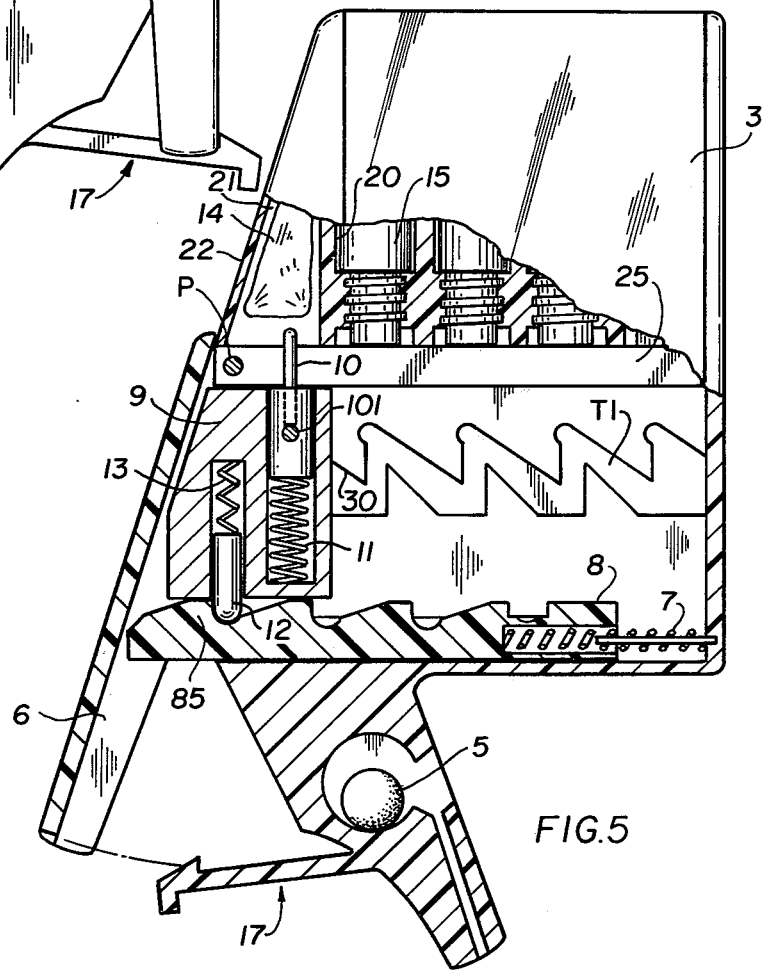
FIG. 5 is a partial, sectional view taken along the line 5—5 of FIG. 7 and showing the safety tab removed and the trigger cocked and ready to fire the first flare.
Figure 6:
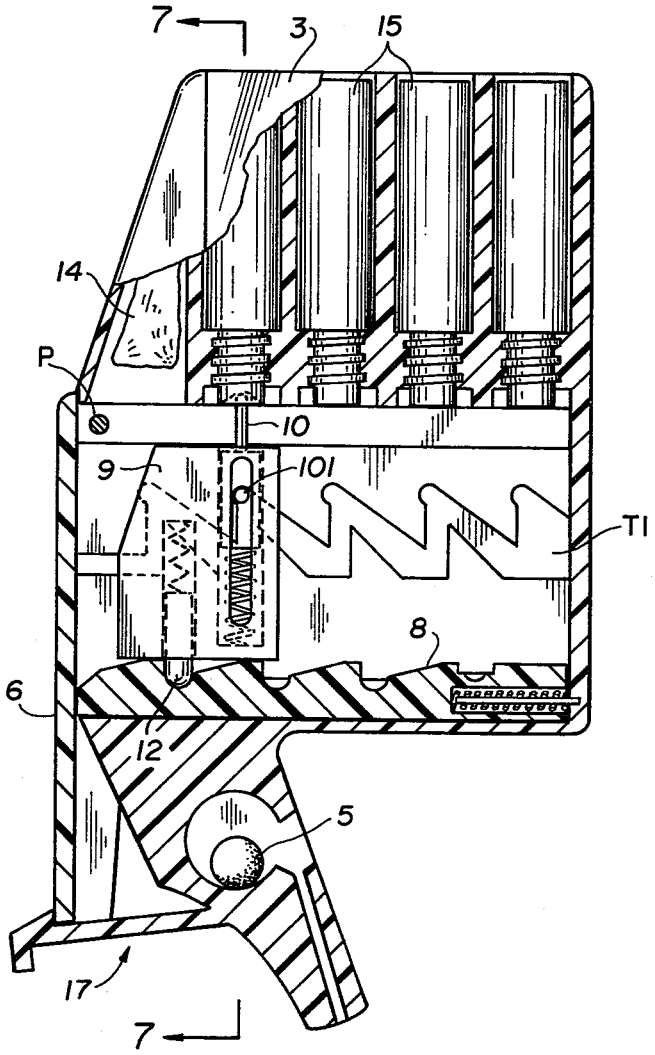
FIG. 6 is a sectional view taken along the lines 6—6 of FIG. 7 and showing the trigger and bolt assembly in position and after the first flare has been fired.
Figure 7:
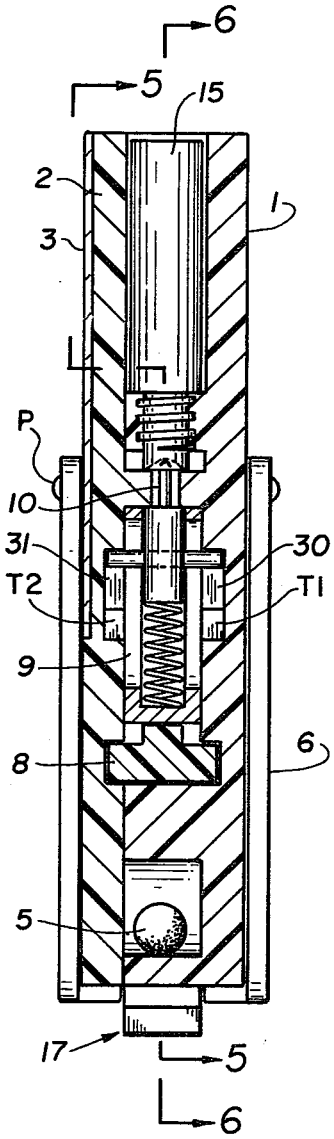
FIG. 7 is a sectional view taken along the lines 7—7 of FIG. 6.

The grip shaped lower portion also forms a whistle, and is internally formed as best seen in FIGS. 3, 5 and 6 with a chamber to house a whistle ball 5.

Figure 8:
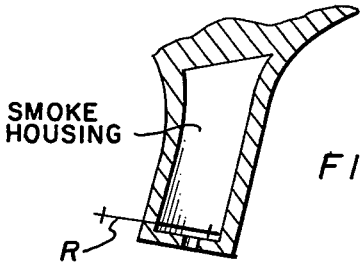
FIG. 8 is a schematic view of a modified handle for use in combination with the signal pack of the invention constructed to be used as a smoke housing.

The grip shaped lower portion may also form a smoke housing as depicted in FIG. 8 and including a release element R for releasing the smoke which may be enclosed within the housing under pressure or may be otherwise pressurized so that the smoke normally including a bright dye is ejected upon release as a daytime visual distress signal.

Self-contained flares 15 are housed within four separate chambers 20 in the upper portion of the pack casing where they may be screwed or press fit as may be desired. Similarly, a marker dye package 14 is also housed in the upper portion of the pack in a compartment 21 enclosed by a removeable cover 22.

Safety bar 17 consists of a flexible bar with a barb on the end. The barb engages the trigger 6 before the trigger is released and the butt mechanism cocked. To release the trigger the outer tip of the bar must be depressed by hand. When the trigger is squeezzed, it again engages the barb and is again captured thereby; the bar keeps the trigger in and the launcher uncocked and is intended as a safety device requiring a further step be performed each time the launcher is to be fired. It also keeps the trigger flush with the launcher making it easier to place the launcher in a pocket or a carrying case.

The trigger 6 is held in an initial safety position (FIG. 1) by safety bar 17 and by a safety tab 16, the belt portion of which surrounds the trigger 6 and handle. The tab may be made of a plastic or other suitable material and may be perforated or otherwise appropriately weakened so that when the tab is pulled, the belt portion will tear and release the trigger 6 when bar 17 is also released.

When the tab is removed and bar 17 is released the trigger 6 is pushed outwardly by slide 8 under the influence of slide spring 7 at which time the bolt 9 is disposed in the position seen in FIG. 5 in which the ratchet pin 12 of the bolt assembly drops under the influence of ratchet spring 13 behind the first ratchet 85 of slide 8. With the bolt assembly 9 in that position, in firing pin 10 is positioned within and extends above slot 25 which communicates with each flare chamber 20.

As the trigger 6 is squeezed toward the lower hand grip portion of the casing, slide 8 is pushed with the trigger inwardly, thus moving the bolt assembly under the influence of ratchet 85 in the same direction. This movement causes firing pin cam follower 101 to ride down the caming surfaces 30, 31 of tracks T1 and T2 extending beneath the flare chambers 20, to the lowest point of surfaces 30, 31 where the firing pin follower 101 is released upwardly under the influence of firing pin spring 11 to fire the first flare at which time, the parts just discussed assume the position shown in FIG. 6.

Repeated squeezing of the trigger 6 will activate the bolt and slide as just described, moving the bolt assembly 9 to fire the next successive flare and the next, etc.

After the last flare has been fired, the firing pin 10 remains within the casing of the flare in the last chamber and no means are provided to return the bolt assembly to an activatable position. Thus, the flare launcher is rendered useless and any illegal re-use thereof is at least discouraged. Such bolt assembly returning means can, of course, be provided if desired.

The invention therefore, provides a signal pack which is primarily a multiple flare launcher which also provides visual and audio distress signal elements in a very compact unit.

Various modifications of the elements and parts just described will now occur to those skilled in the art. The invention contemplates such modifications and is only to be limited in scope by the following claims:

I claim:

1. A multiple signal unit launcher comprising a plurality of signal units positioned in side by side array, and communicating at their lower ends with a common slot, single unit firing means positioned beneath said slot and said units, slide means for moving said firing means from adjacent one unit to the next and complementary cam and cam follower means engaged with each other for guiding said firing means and for activating the same for firing each unit separately.

2. A signal pack comprising a housing, a plurality of flare chambers within which are received flares, said flare chambers and flares being positioned in side by side array, and communicating at their lower ends with a common slot, single flare firing means positioned beneath said slot and said flares, slide means for moving said firing means from adjacent one flare chamber to the next and complementary cam and cam follower means engaged with each other on said housing and on said firing means for guiding said firing means and for activating the same for firing each flare separately.

3. The signal pack of claim 2 wherein said housing is formed at its lower end as a grip element and a trigger for activating said firing means extends externally of said housing and is juxtaposed to said grip element for co-action therewith, to activate said firing means.

4. The signal pack of claim 3, wherein said grip element is formed internally as a whistle chamber for the retention of a whistle ball and said grip element comprises with said whistle chamber and ball, a whistle.

5. The signal pack of claim 2, wherein said housing provides on its outer surface a signal mirror.

6. The signal pack of claim 2, wherein said housing provides a separate storage chamber in which is stored a visual distress signalling means.

7. The signal pack of claim 2, wherein said housing is formed at its lower end as a grip element and a trigger for activating said firing means extends externally of said housing and is juxtaposed to said grip element for co-action therewith to activate said firing means, said grip element being formed internally as a whistle chamber for the retention of a whistle ball and said grip comprises with said whistle chamber and ball, a whistle, said housing provides on its outer surface a signal mirror; and said housing provides a separate storage chamber in which is stored visual distress signalling means.

8. The signal pack of claim 2, wherein said firing means comprises a spring and bolt in a spring loaded assembly and said cam follower means is on said firing means and operatively associated with the bolt and spring thereof; said cam means including surface means for cocking said bolt against said spring and for releasing said bolt under the influence of said spring as said bolt assembly is moved adjacent each chamber.

9. A signal pack comprising a housing, a plurality of flare chambers within which are secured flares, and communicating at their lower ends with a slotted area, singular flare firing means positioned beneath said slotted area and said chambers, means for moving said singular firing means from adjacent one chamber to the next and including means for actuating said singular firing means for firing each flare separately.

10. The signal pack of claim 9, wherein said housing comprises an outer casing formed of assymetric right and left hand sides fabricated from a high impact plastic.

11. The signal pack of claim 9, wherein said means for moving said firing means from one chamber to the next constitutes the sole means for moving said firing means with no means for returning the same to adjacent the first chamber whereby the pack is rendered useless for further use after the last flare is fired.

12. The signal pack of claim 9, wherein said housing is formed at its lower end as a grip element and a trigger for activating said firing means extends externally of said housing and is juxtaposed to said grip element for co-action therewith to activate said firing means, said grip element being formed internally as a smoke chamber and said grip element comprises with said smoke chamber means for releasing said smoke as a daytime signal.

* * * * *